United States Patent [19]

Holden et al.

[11] Patent Number: 4,573,941

[45] Date of Patent: Mar. 4, 1986

[54] STEERABLE TOY VEHICLE

[75] Inventors: John Holden, Mt. Joy, Pa.; Sam Colombrito, Old Bridge, N.J.; Arthur H. Jeffreys, York, Pa.

[73] Assignee: Buddy L Corp., New York, N.Y.

[21] Appl. No.: 643,394

[22] Filed: Aug. 23, 1984

[51] Int. Cl.[4] ..... A63H 17/38

[52] U.S. Cl. ..... 446/451; 446/454; 446/469

[58] Field of Search ..... 446/451, 468, 465, 431, 446/437, 460, 454, 469

[56] References Cited

U.S. PATENT DOCUMENTS

| | | | |
|---|---|---|---|
| 2,167,245 | 7/1939 | Lohr et al. | 446/451 |
| 4,327,517 | 5/1982 | Schwager | 446/454 X |

FOREIGN PATENT DOCUMENTS

| | | | |
|---|---|---|---|
| 803701 | 4/1951 | Fed. Rep. of Germany | 446/454 |
| 816813 | 10/1951 | Fed. Rep. of Germany | 446/451 |
| 665334 | 1/1952 | United Kingdom | 446/460 |

*Primary Examiner*—F. Barry Shay
*Attorney, Agent, or Firm*—Michael Ebert

[57] ABSTRACT

A four-wheeled toy vehicle provided with a driver's cab and a steering post therebehind which extends above the body of the vehicle and makes it possible for a player to steer the vehicle from its exterior. Each front wheel has a short axle which extends transversely through a bearing that is pivotally supported on a vertical axis at right angles to the axle whereby the wheel is steerable. The steering post passes through the chassis and terminates in a crank at right angles to the post at the underside of the vehicle. The crank is pivotally connected to the leg of a T-shaped lever having arms extending outwardly from opposite sides of the leg, the lever fulcrum being at the junction of the leg and the arms whereby rotation of the crank in one direction by the steering post causes the arms to swing in the opposite direction. Each arm is pivotally connected to the bearing of a respective front wheel to effect steering thereof as the arms swing.

4 Claims, 6 Drawing Figures

STEERABLE TOY VEHICLE

BACKGROUND OF THE INVENTION

1. Field of Invention

This invention relates generally to toy vehicles, and more particularly to a free-wheeling toy vehicle which the player can steer from the exterior thereof as he propels the vehicle along a road surface.

The conventional full scale pick-up truck is a light truck having an open body with low sides and a tail-board. Such trucks are highly useful, all purpose cargo carriers. Thus, on a farm a pick-up truck may be used to transport animals and a variety of objects, for an open truck of this type can be readily loaded and unloaded.

Toy vehicles having the same appearance as a pick-up truck are popular with young children; for in play, the truck may be loaded with tiny objects and moved to a destination and unloaded in a manner comparable to a real truck operation. The most successful toys are those which permit a child to emulate some adult activity which he has observed. It is for this reason that play houses are ever popular, for the child can furnish and people the house, and pretend to assume an adult role in this regard.

Free-wheeling toy vehicles which look like real pick-up trucks are known, such vehicles having no motor and being propelled on the floor or any other road surface by the child. The reason these vehicles fall short of a child's expectation is that they cannot be steered realistically in the manner of a genuine truck, and the child is therefore unable to propel the truck along a meandering and hence a more interesting path toward his play destination.

2. Prior Art

Toy vehicles are known in the art which incorporate various forms of relatively complex steering mechanisms and are therefore costly to manufacture. Thus the patent to De Filippis, U.S. Pat. No. 1,357,491 provides a pantograph steering mechanism in conjunction with friction wheels to engage the front wheels. Along similar lines is the steering mechanism shown in the patent to Brown, U.S. Pat. No. 3,131,508.

Also of background interest are the patents to Roberts et al., U.S. Pat. No. 3,780,470; Ernst, U.S. Pat. No. 2,603,913 and Strongin, U.S. Pat. No. 3,717,952.

SUMMARY OF INVENTION

In view of the foregoing, the main object of this invention is to provide a four-wheeled toy vehicle which is steerable by the player from the exterior thereof so that the child, as he propels the vehicle, can also change its direction of movement and cause the vehicle to travel in any desired path, however circuitous.

More particularly, an object of this invention is to provide a steerable toy vehicle which simulates a pick-up truck having a driver cab and an open body, the steering post being placed behind the cab and having a handle bar making it possible for the player to steer the truck as he wishes.

Also an object of the invention is to provide a steerable vehicle in which the steering mechanism for the front wheels is housed within a two-piece box secured to the underside of the vehicle, the box pieces also defining the journals for the pivoted bearings of the front wheel axles.

Still another object of the invention is to provide a steerable vehicle of exceptionally simple mechanical design which can be manufactured and assembled at low cost.

Briefly stated, these objects are attained in a four-wheeled toy vehicle provided with a driver's cab and a steering post therebehind which extends above the body of the vehicle and makes it possible for a player to steer the vehicle from its exterior. Each front wheel has a short axle which extends transversely through a bearing that is pivotally supported on a vertical axis at right angles to the axle whereby the wheel is steerable. The steering post passes through the chassis and terminates in a crank at right angles to the post at the underside of the vehicle. The crank is pivotally connected to the leg of a T-shaped lever having arms extending outwardly from opposite sides of the leg, the lever fulcrum being at the junction of the leg and the arms whereby rotation of the crank in one direction by the steering post causes the arms to swing in the opposite direction. Each arm is pivotally connected to the bearing of a respective front wheel to effect steering thereof as the arms swing.

OUTLINE OF DRAWINGS

For a better understanding of the invention as well other objects and further features thereof, reference is made to the following detailed description to be read in conjunction with the accompanying drawings, wherein.

DESCRIPTION OF INVENTION

Figure 1:
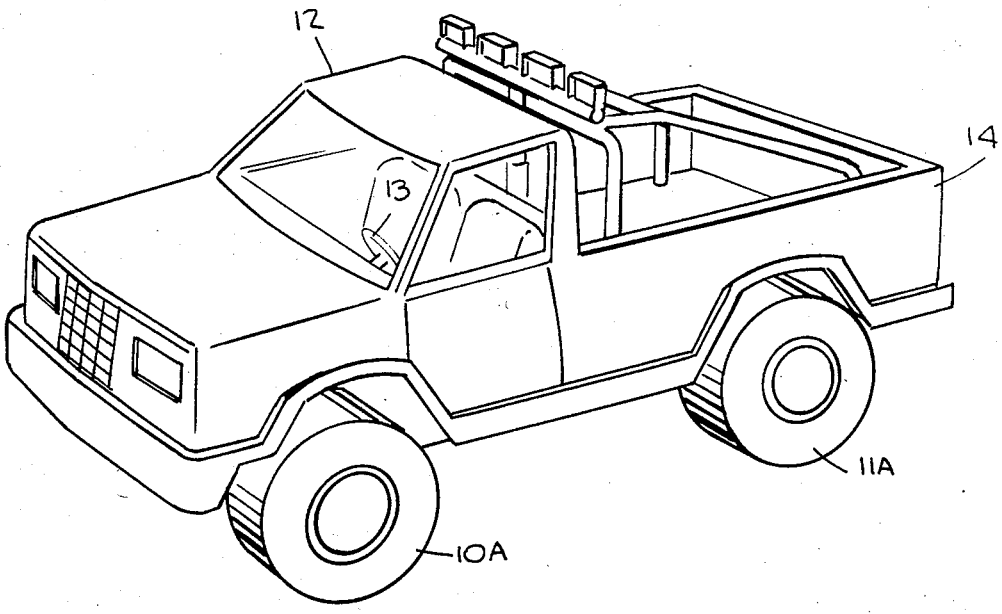
FIG. 1 illustrates, in perspective, a toy pick-up truck in accordance with the invention.
Figure 2:
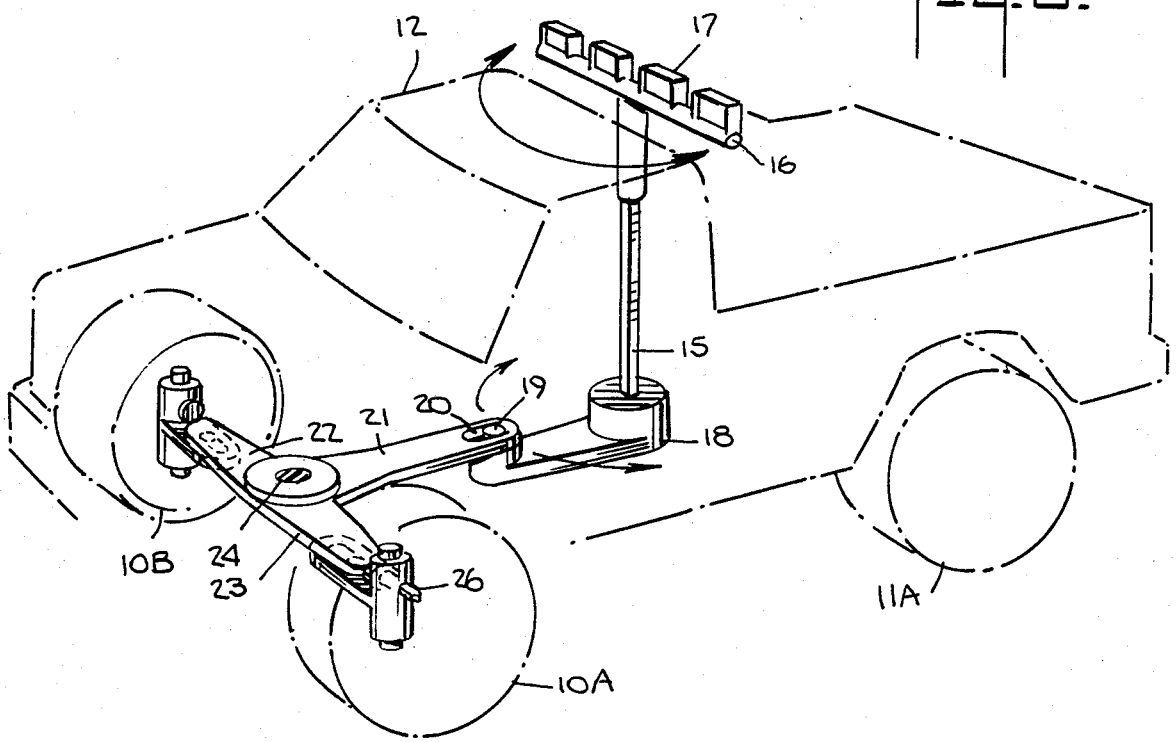
FIG. 2 is a see-through view of the truck to reveal the internal steering mechanism for the front wheels.

Referring now to FIGS. 1 and 2, there is shown a toy pick-up truck in accordance with the invention having a pair of steerable front wheels 10A and 10B, a pair of rear wheels 11A and 11B, a driver's cab 12 having a mock steering wheel 13 therein, and an open body 14 provided with low sides and a tail board as in a full scale pick-up truck.

Positioned directly behind cab 12 is a vertical steering post 15 on whose upper end is attached a handle bar 16 for turning the post. Alternatively, a steering wheel may be used for this purpose. Bar 16 is provided with a row of simulated signal lights 17 so that to all appearances the rear of the cab has a row of signal lights thereon imitative of those pick-up trucks which are used for emergency purposes.

Steering post 15 passes through the chassis of the truck and terminates in the crank 18 of a steering mechanism on whose free end is an upwardly projecting pivot pin 19, the crank being at right angles to the post. Pivot pin 19 is received within a slot 20 formed at the end of the leg 21 of a T-shaped lever having a pair of transverse arms 22 and 23 reaching out from opposite sides of the leg. The fulcrum of this lever is at the junction of leg 21 and arms 22 and 23, the lever turning about a fulcrum pivot pin 24.

Figure 3:
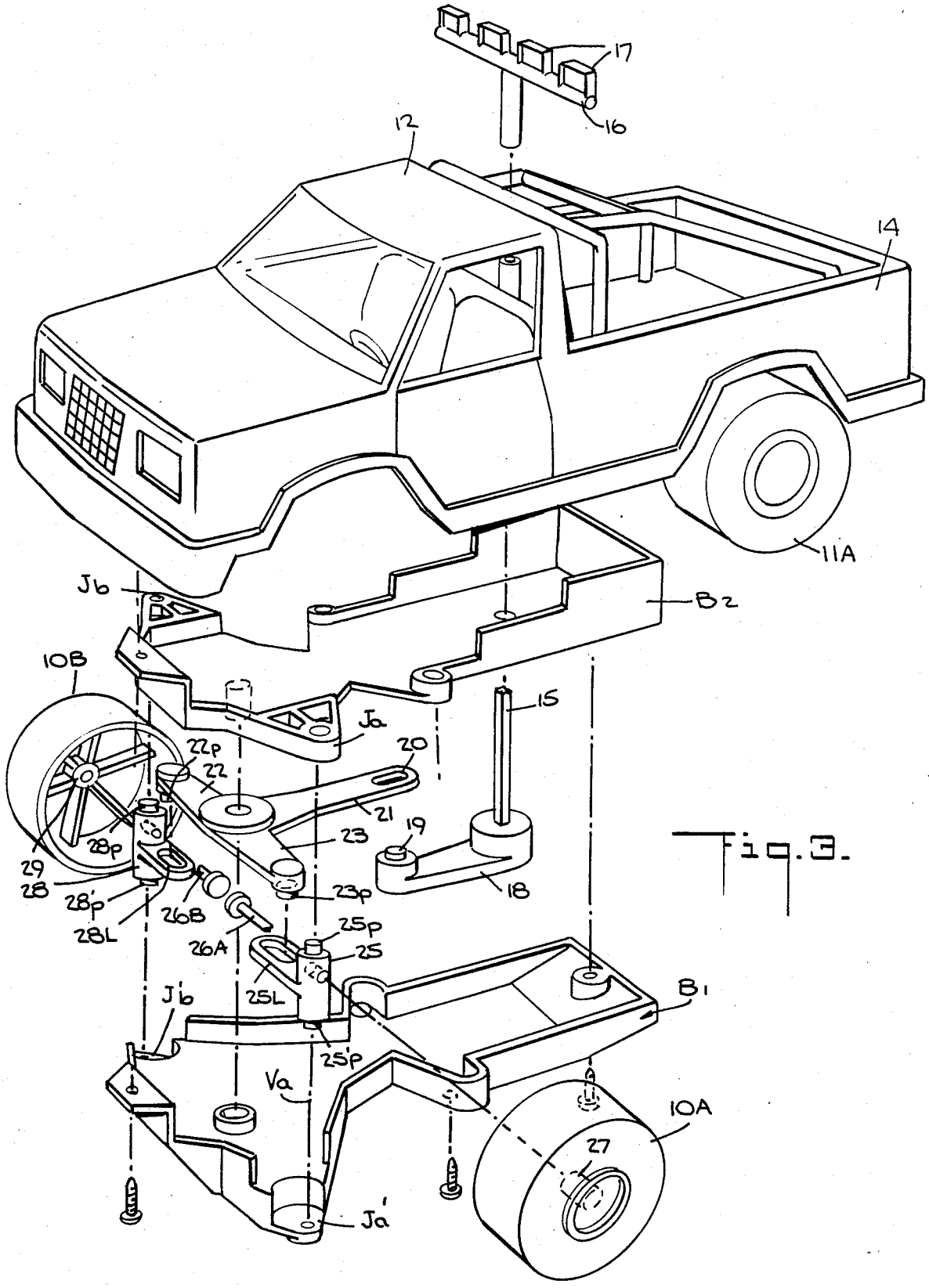
FIG. 3 is an exploded view of the steering mechanism.

As best seen in FIG. 3, the steering mechanism is housed in the underside of the vehicle within a molded plastic box secured by screws to the vehicle chassis, the box having a lower piece $B_1$ and a matching upper piece $B_2$. The front end of the box at side positions corresponding to those of the front wheels 10A and 10B is contoured to define a set of upper and lower journals $J_a$ and $J'_a$ and a set of upper and lower journals $J_b$ and $J'_b$.

Clamped between journals $J_a$ and $J'_a$ is a cylindrical bearing 25 having pivot pins $\mathbf{25}_p$ and $\mathbf{25'}_p$ projecting axially from either end which are received in journals $J_a$ and $J'_a$, respectively, whereby the bearing is rotatable about the vertical axis $V_a$ passing through these journals. Wheel 10A is mounted on a short axle 26A having an enlarged head. The axle passes through bearing 25 at right angles to vertical axis $V_a$ and is secured to the inner hub 27 of wheel 10A so that the wheel is free to rotate on this short axle.

Bearing 25 is provided with a laterally-extending lug 25L having a slot therein which receives a pivot pin $\mathbf{23}_p$ projecting downwardly from the end of lever arm 23.

The second front wheel 10B is linked to the steering mechanism in a like manner, this wheel rotating on a short axle 26B which passes through a bearing 28 into the hub 29 of the wheel. The pivot pins $\mathbf{28}_p$ and $\mathbf{28'}_p$ of bearing 28 are socketed in journals $J_b$ and $J'_b$, so that the bearing is clamped therebetween. The lateral lug 28L of bearing 28 has a slot which receives the pivot pin $\mathbf{22}_p$ projecting downwardly from the end of lever arm 22. Front wheels 10A and 10B are both hollow so that the related bearings are accommodated therein.

Figure 4:
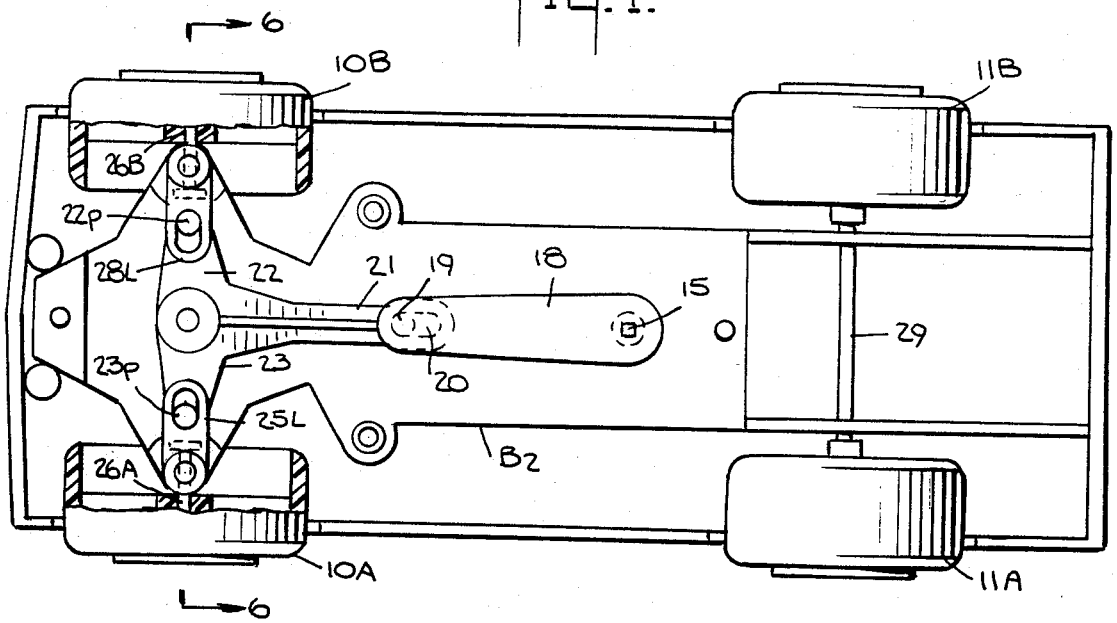
FIG. 4 illustrates the underside of the vehicle with the lower piece of the two piece box housing the steering mechanism removed, showing the steering mechanism as it is positioned when front wheels are parallel to the longitudinal axis of the vehicle to provide straight line travel.

Referring now to FIG. 4, it will be seen that the free-running rear wheels 11A and 11B rotate on a long axle 29, while front wheels 10A and 10B rotate on their respective short axles 26 and 27. When crank 18 of the steering mechanism is in line with the longitudinal axis of the vehicle, the front wheels 10A and 10B are parallel to this axis for straight line travel.

Figure 5:
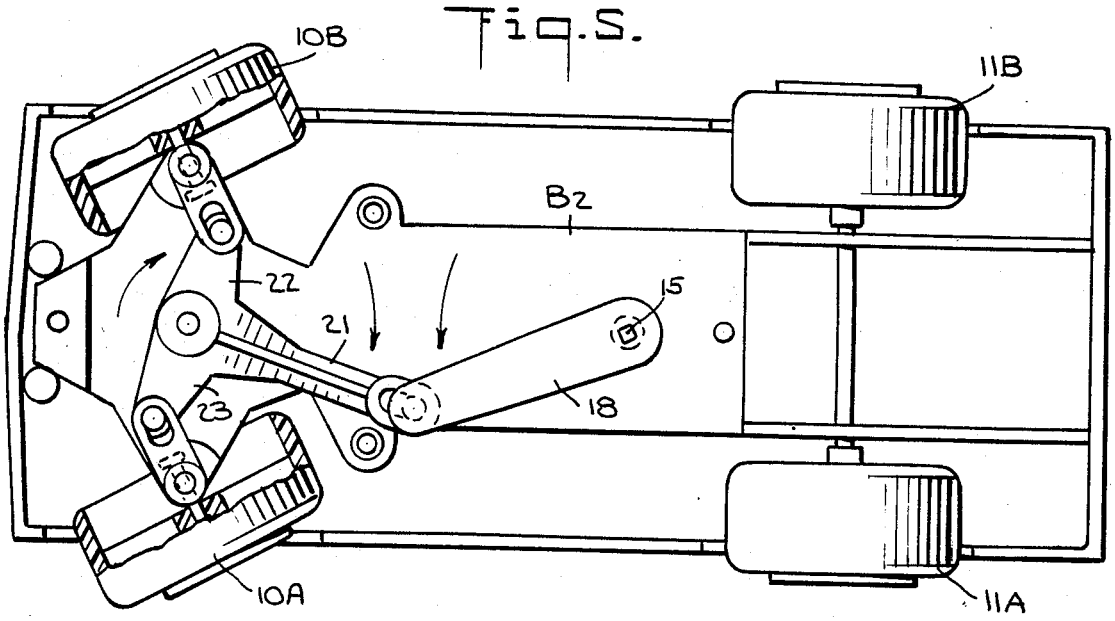
FIG. 5 is the same as FIG. 4, but with the front wheels steered to an inclined position relative to the longitudinal axis.
Figure 6:
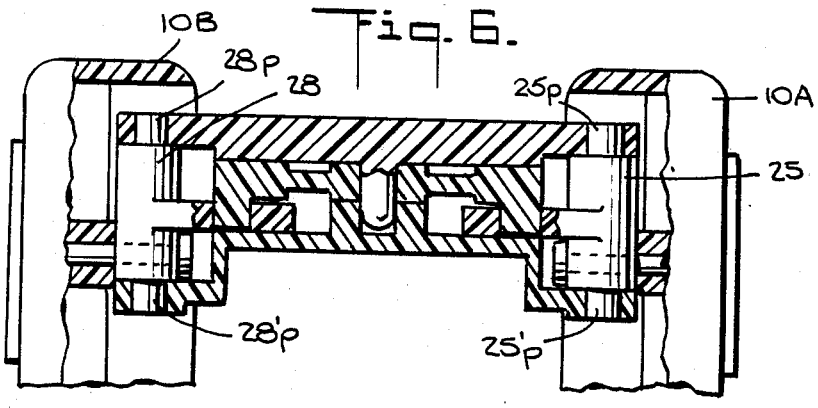
FIG. 6 is a transverse section taken in the plane indicated by lines 6—6 in FIG. 4.

But when crank 18 is turned counterclockwise by steering post 15, as shown in FIG. 5, then the outstretched arms 22 and 23 of the lever are caused to swing in the clockwise direction to an extent determined by the movement of crank 18. And when crank 18 is turned clockwise, this results in a counterclockwise swing of the lever arms. Thus the front wheels 10A and 10B are steered in either direction at an angle to the longitudinal axis of the vehicle, such steering being under the control of the player who manipulates the handle bar of the steering post.

In this way, the player, as he propels the toy pick-up truck, can also control its direction of travel in any desired manner by means of the steering mechanism.

While there has been shown and described a preferred embodiment of a steerable toy vehicle in accordance with the invention, it will be appreciated that many changes and modifications may be made therein without, however, departing from the essential spirit thereof.

We claim:

1. A steerable, four-wheeled toy vehicle comprising:

A. right and left front wheels and right and left rear wheels supported for rotation on the chassis of the vehicle;

B. a vertical steering post having a handle secured to the upper end thereof at a raised position with respect to the body of the vehicle so that it can be manipulated by a player, the post extending through the chassis and terminating in a crank at the underside of the vehicle at right angles to the post;

C. a T-shaped lever having a leg pivotally connected to the crank and right and left outstretched arms on either side of the leg, the fulcrum of the lever being at the junction of the leg and the arms, whereby when the crank is turned by the post in one direction, the arms of the lever are caused to swing in the opposite direction;

D. a bearing provided with axially extending end pivots for each of the front wheels for receiving a short wheel axle anchored in the hub of the related front wheel, the pivots of said bearings being journaled at fixed points on opposite sides of the longitudinal axis of the vehicle, each for rotation about a respective vertical axis normal to the wheel axle, the bearing for the right front wheel being pivotally coupled to the right arm and the bearing for the left front wheel being pivotally coupled to the left arm of the lever, each bearing having a lateral lug with a slot therein which receives a pivot pin on the associated lever arm whereby when the steering post is turned by the handle, the front wheels are steered so that they both assume the same angle with respect to the longitudinal axis of the vehicle but do not otherwise shift with respect to said fixed points;

E. A two-piece box secured to the underside of the vehicle and enclosing the crank, the lever and the pivoted couplings between the bearings and arms, said box defining the journals for the pivots of said bearings.

2. A vehicle as set forth in claim 1, wherein said vehicle has the appearance of a pick-up truck having a driver cab, said post being disposed behind said cab.

3. A vehicle as set forth in claim 2, wherein said handle is a handle bar having simulated light signals thereon.

4. A vehicle as set forth in claim 1, wherein said crank has a slot at its free end, and said leg has an end pin which is received in said slot.

* * * * *